US007609206B1

(12) United States Patent
Jensen et al.

(10) Patent No.: US 7,609,206 B1
(45) Date of Patent: Oct. 27, 2009

(54) ENABLING DIGITAL BEAMFORMING TECHNIQUES FOR RF SYSTEMS HAVING SHORT REPETITIVE SYNCHRONIZATION SEQUENCES

(75) Inventors: Dana J. Jensen, Marion, IA (US); Scott J. Zogg, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 12/012,433

(22) Filed: Feb. 1, 2008

(51) Int. Cl.
*H01Q 3/00* (2006.01)

(52) U.S. Cl. ..... 342/377; 342/372; 342/373

(58) Field of Classification Search ..... 342/81, 342/154, 368, 372, 373, 377
See application file for complete search history.

(56) References Cited

U.S. PATENT DOCUMENTS

| | | | |
|---|---|---|---|
| 6,556,809 | B1 | 4/2003 | Gross |
| 7,286,800 | B2 | 10/2007 | Maruta |
| 7,289,580 | B2 | 10/2007 | Pladdy |
| 7,305,054 | B2 | 12/2007 | Talwar |

*Primary Examiner*—Dao L Phan
(74) *Attorney, Agent, or Firm*—Daniel M. Barbieri

(57) ABSTRACT

A system and method of enabling digital beamforming (DBF) for use with RF receiver systems with a multi-element array antenna having short repetitive synchronizaton sequences in a noise and/or jamming environment. The method includes the following steps: a) receiving repetitive synchronization RF signals utilizing a multi-element array antenna, each of the repetitive synchronization RF signals includes an ideal known synchronization sequence, the ideal known synchronization sequence is denoted as $y_d$ and a length of the ideal known synchronization sequence is denoted as $N_d$; b) calculating a sequence of magnitudes and phases for each element of the multi-element array antenna corresponding to each of the ideal known synchronization sequences in the received synchronization RF signals, the sequence of the magnitudes and the phases comprises an array of N elements and is denoted as x, wherein the phases are also referred to as absolute phases; c) calculating a relative phase for each element in the sequence of the magnitudes and the absolute phases by referencing the absolute phases of all elements in the array x of N elements to a phase of a single element in the array x of N elements; d) converting the array x of N elements with the magnitudes and the absolute phases into an array of N elements with the magnitudes and the relative phases by replacing each of the absolute phases in the array x of N elements with the calculated relative phase for each element, the array of N elements with the magnitudes and the relative phases is denoted as $x_r$; e) calculating a relative cross correlation vector for each element of the multi-element array antenna utilizing $x_r$ and $y_d$, the relative cross correlation vector is denoted as $r_{xd}$, where $r_{xd}=E\{x_r y_d^*\}$ and * is a complex conjugate; and, f) generating a relative cross correlation vector estimate by filtering $r_{xd}$, for use with DBF techniques.

18 Claims, 7 Drawing Sheets

ENABLING DIGITAL BEAMFORMING TECHNIQUES FOR RF SYSTEMS HAVING SHORT REPETITIVE SYNCHRONIZATION SEQUENCES

BACKGROUND OF THE INVENTION

1. Field of the Invention

The present invention relates generally to techniques for enabling digital beamforming in radio-frequency (RF) receiver systems and more specifically to methods and apparatus for enabling digital beamforming in an RF receiver system with a multi-element array antenna having short repetitive synchronization sequences in a noise and/or jamming environment.

2. Description of the Related Art

Multi-element array antenna can offer advantages over traditional mechanically steered directional antennas. For example, the use of digital beamforming (DBF) techniques can allow reception from multiple simultaneous streams. DBF algorithms can be used to determine the weight vector, which is used to combine the signals from the antenna elements, resulting in an improved receive signal. Some standard DBF algorithms rely on first and second order statistics, that is, the cross correlation vector and covariance matrix.

As discussed herein, DBF techniques include not only those employed with calibrated phased array antennas, such as phasing up elements to electrically 'point' the array, but also those that can be used with multi-element arrays that don't require antenna calibration or a specific antenna geometry and element spacing. One such method is minimum mean squared error (MMSE). This technique uses the cross correlation vector and covariance matrix to calculate a weight vector that minimizes the signal to noise plus interference (SINR) of the combined signal.

In standard approaches, to obtain accurate estimates of the first and second order statistics, it is advantageous to use many samples when calculating the cross correlation vector and covariance matrix. This is particularly relevant when attempting to receive signals in strong noise and/or interference. This can be the case in the presence of a jammer, or in a network allowing co-channel interference, for example, a network with nodes capable of receiving multiple simultaneous signals.

However, it is not always possible to operate on long sequences. The cross correlation vector correlates a sequence on all elements with the ideal known sequence. If the known sequence is short, the correlation output may provide a poor estimate. The length of sequences used for the covariance matrix estimate may be limited by hardware (processing and/or memory).

U.S. Pat. No. 7,289,580, issued to Pladdy, et al., entitled, "Channel Estimator Using One Or More Correlation Reference Vectors to Eliminate Data Related Noise", discloses a method of estimating the channel impulse response of a channel comprising the following: performing a plurality of correlations, wherein each of the correlations provides a substantially noise-free estimate of the impulse response of a different portion of the channel; and, combining the plurality of substantially noise-free estimates to provide an estimate of the channel impulse response.

U.S. Pat. No. 7,286,800, issued to Maruta, entitled, "Multi-Beam Antenna Reception Device and Multi-Beam Reception Method", discloses a multibeam antenna reception device capable of improving the reception quality while suppressing an increase in the amount of computation. The multibeam antenna reception device includes a path detection control section for controlling the path detection range at the current time for M receive beam path detection sections based on pairs of receive beam numbers and path delays detected prior to the current time and information on user signal reception quality in the pairs of the receive beam numbers and the path delays output from the M receive beam path detection sections. When path detection is performed with respect to each user in the M receive beam path detection sections, pairs of receive beam numbers and path delays and information on user signal reception quality in the pairs of the receive beam numbers and the path delays are detected according to the path detection range controlled by the path detection control section.

U.S. Pat. No. 6,556,809, issued to Gross, et al., entitled, "Method and Apparatus for Controlling Communication Beams Within a Cellular Communication System", discloses a beam control subsystem that provides acquisition, synchronization, and traffic beams to communication devices within a footprint of a system node, where each beam comprises a set of beamlets. The subsystem first acquires and synchronizes with each communication device. Acquisition involves selecting and combining sets of beamlets, and determining whether any devices within the sets are attempting to acquire the system. If so, synchronization is performed by varying beamlet weighting coefficients to find, based on modem feedback, a combination of coefficients that yields a maximum signal-to-interference+noise ratio for multiple users within a beam. The communication device is then handed off to a traffic beam. The subsystem continues, based on modem feedback, to adapt beamlet weighting coefficients in order to track the traffic beam in a manner that provides the maximum SINR.

U.S. Pat. No. 7,305,054, issued to Walwar, entitled, "Robust Multiple Chain Receiver", discloses a method and system for receiving multiple signals at a multiple channel receiver. The receiver is adaptable to receive information signals that are dominated by either noise or interference. The method and system of the invention are implemented with existing multiple channel weighted receivers.

SUMMARY OF THE INVENTION

In a broad aspect, the present invention is a method of enabling digital beamforming (DBF) for use with RF receiver systems with a multi-element array antenna having short repetitive synchronization sequences in a noise and/or jamming environment. The method of enabling DBF techniques includes the following steps:

a) receiving repetitive synchronization RF signals utilizing a multi-element array antenna, each of the repetitive synchronization RF signals includes an ideal known synchronization sequence, the ideal known synchronization sequence is denoted as $y_d$ and a length of the ideal known synchronization sequence is denoted as $N_d$;

b) calculating a sequence of magnitudes and phases for each element of the multi-element array antenna corresponding to each of the ideal known synchronization sequences in the received synchronization RF signals, the sequence of the magnitudes and the phases comprises an array of N elements and is denoted as x, wherein the phases are also referred to as absolute phases;

c) calculating a relative phase for each element in the sequence of the magnitudes and the absolute phases by referencing the absolute phases of all elements in the array x of N elements to a phase of a single element in the array x of N elements;

d) converting the array x of N elements with the magnitudes and the absolute phases into an array of N elements with the magnitudes and the relative phases by replacing each of the absolute phases in the array x of N elements with the calculated relative phase for each element, the array of N elements with the magnitudes and the relative phases is denoted as $x_r$;

e) calculating a relative cross correlation vector for each element of the multi-element array antenna utilizing $x_r$ and $y_d$, the relative cross correlation vector is denoted as $r_{xd}$, where $r_{xd}=E\{x_r y_d^*\}$ and * is a complex conjugate; and, f) generating a relative cross correlation vector estimate by filtering $r_{xd}$, for use with DBF techniques.

The method of enabling the DBF technique may further include the step of utilizing the relative cross correlation vector estimate for maximal ratio combining.

The method of enabling the DBF technique may further include the step of utilizing $x_r$ to calculate a covariance matrix containing results of signals arriving on any element of the multi-element array antenna with signals arriving on all other elements of the multi-element array antenna.

The present invention improves the estimate of the cross correlation estimate. Without this, the estimate made on a short repetitive synchronization sequence would, under many circumstances, be too corrupted by noise and jamming interference to be used for DBF techniques.

DETAILED DESCRIPTION OF THE INVENTION

Figure 1:
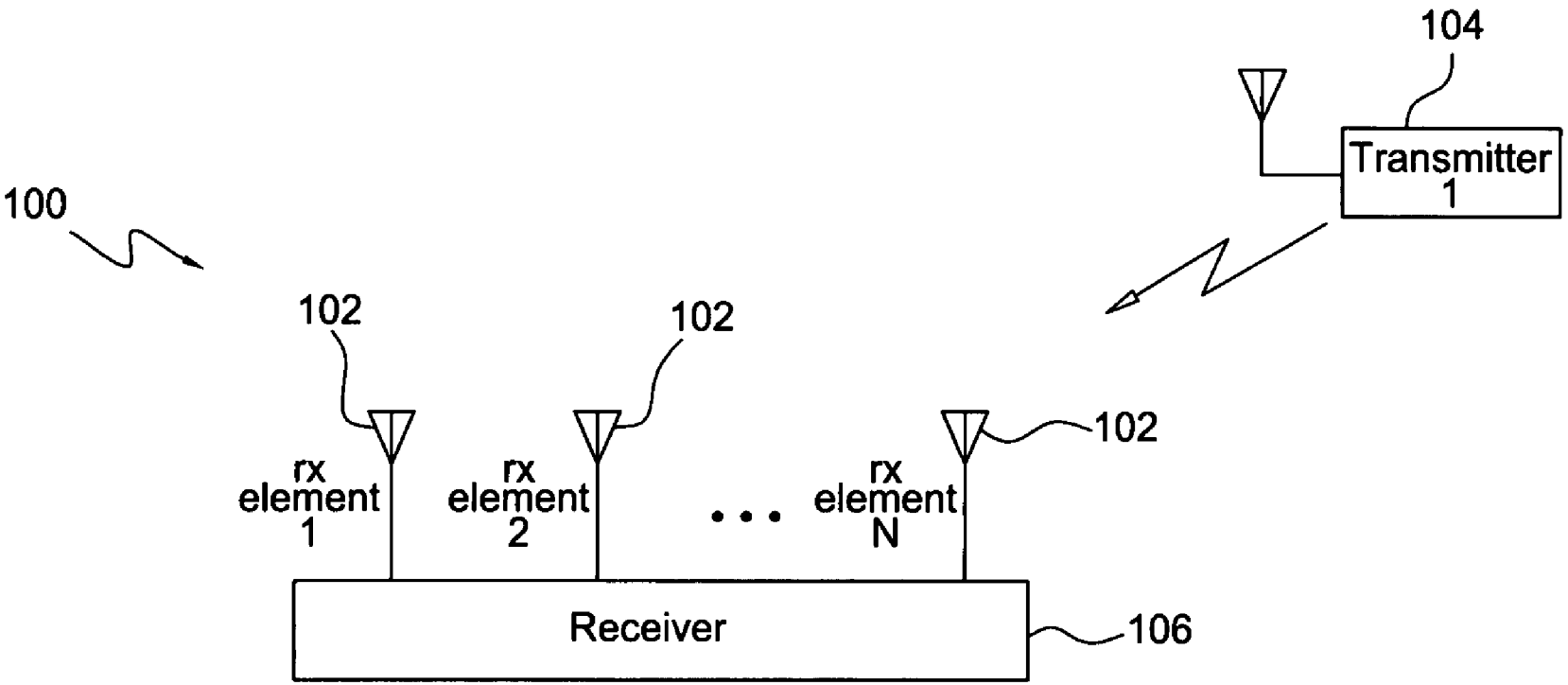
FIG. 1 is a block diagram of an RF receiver system with a multi-element array antenna receiving RF signals from one RF transmitter source.

Referring now to FIG. 1, an RF receiver system of the present invention, with a multi-element array antenna 102 receiving RF signals from one RF transmitter source 104, is illustrated, designated generally as 100. The RF receiver system 100 includes a multi-element array antenna 102 and an RF receiver 106.

Figure 2:
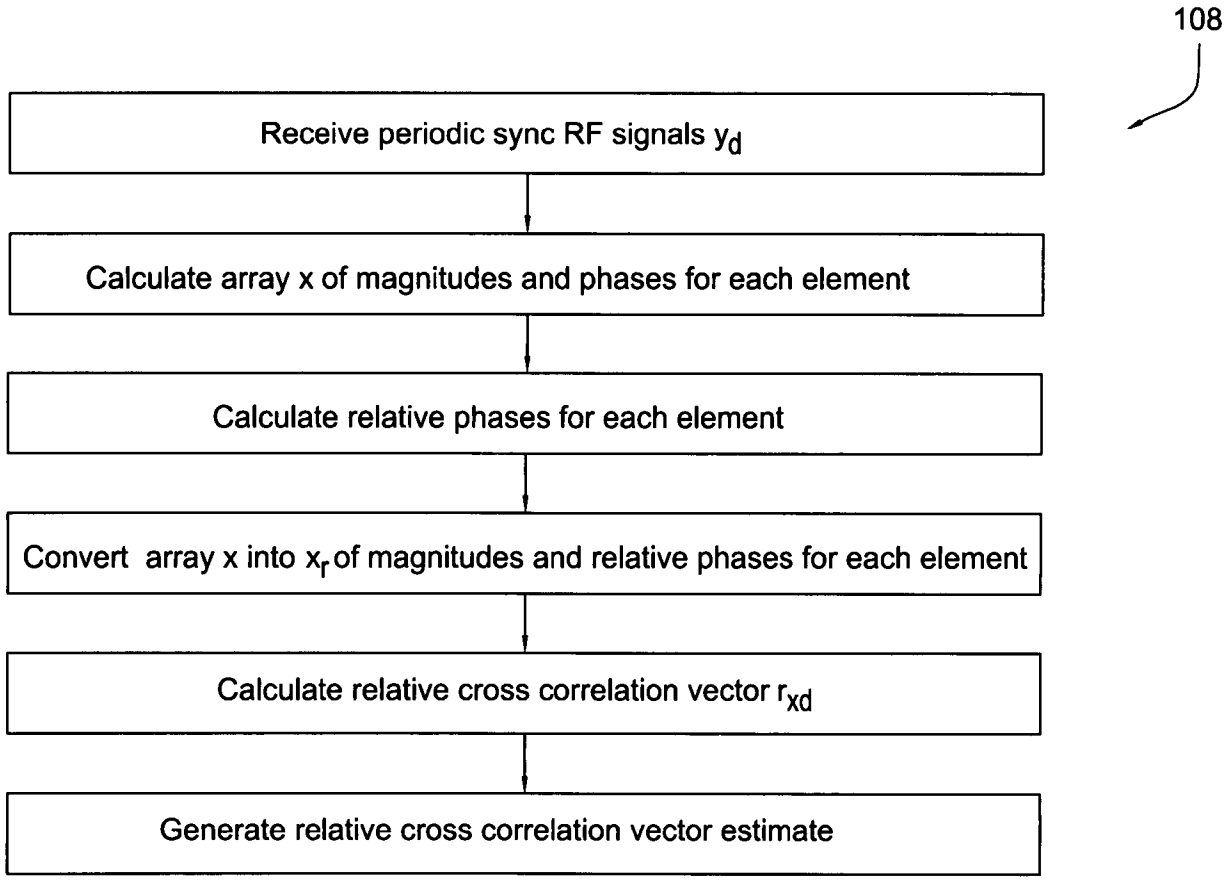
FIG. 2 is a block diagram of enabling DBF techniques for RF receiver systems with a multi-element array antenna having short repetitive synchronization sequences.

Referring now to FIG. 2, a block diagram of a method of enabling DBF techniques for RF receiver systems with a multi-element array antenna having short repetitive synchronization sequences receiving RF signals in a noise environment is illustrated, generally designated at 108. The method can be summarized by the following steps:

a) receiving repetitive synchronization RF signals utilizing a multi-element array antenna, each of the repetitive synchronization RF signals including an ideal known synchronization sequence, the ideal known synchronization sequence is denoted as $y_d$ and a length of the ideal known synchronization sequence is denoted as $N_d$;

b) calculating a sequence of magnitudes and phases for each element of the multi-element array antenna corresponding to each of the ideal known synchronization sequences in the received synchronization RF signals, the sequence of the magnitudes and the phases comprises an array of N elements and is denoted as x, wherein the phases are also referred to as absolute phases;

c) calculating a relative phase for each element in the sequence of the magnitudes and the absolute phases by referencing the absolute phases of all elements in the array x of N elements to a phase of a single element in the array x of N elements;

d) converting the array x of N elements with the magnitudes and the absolute phases into an array of N elements with the magnitudes and the relative phases by replacing each of the absolute phases in the array x of N elements with the calculated relative phase for each element, the array of N elements with the magnitudes and the relative phases is denoted as $x_r$;

e) calculating a relative cross correlation vector for each element of the multi-element array antenna utilizing $x_r$ and $y_d$, the relative cross correlation vector is denoted as $r_{xd}$, where $r_{xd}=E\{x_r y_d^*\}$ and * is a complex conjugate; and, f) generating a relative cross correlation vector estimate by filtering $r_{xd}$, for use with DBF techniques.

The synchronization sequence may be periodic; however, this is not necessary. Any known sequence at intervals (not necessarily uniformly spaced in time) would allow correlation with the expected sequence.

The RF receiver 106 includes components typically found in a receiver such as a preamplifier, amplifier, mixer, local oscillator, analog to digital converter, and digital signal processor (DSP). The DSP is programmed to perform the steps discussed above relative to FIG. 2.

The relative cross correlation vector estimate may further be utilized for maximal ratio combining (MRC). MRC basically produces a coherent sum of the signals arriving at each element. With a calibrated phased array and ideal cross correlation results, this essentially points the array in the direction of the received signal. When standard cross correlation results are used, the constellation of the resulting combined signal has a phase of 0°. For example, a QPSK constellation would be aligned with the in-phase and quadrature-phase axes. However, with relative phase in the cross correlation vector, the constellation after combining will not be aligned. A final correlation with the known sequence can be used to determine and correct the phase offset.

The method of enabling DBF techniques further utilizes $x_r$ to calculate a covariance matrix containing results of signals arriving on any element of the multi-element array antenna with signals arriving on all other elements of the multi-element array antenna, the covariance matrix is denoted as $R_x$, where $R_x=E\{x_r x_r^H\}$ and H is Hermitian transpose. The covariance matrix already deals with relative phase of signals received on one antenna element with respect to another. Therefore, it is not necessary to remove the phase of a reference element prior to averaging or filtering. Typically, a relatively long sequence is used to obtain covariance results. However, when it is not possible to perform correlations on a long sequence, covariance results made on short synchronization sequences can be averaged or filtered.

The method of enabling DBF techniques further utilizes the relative cross correlation vector estimate in a weight vector algorithm to reduce noise and interference. The signals from each of the elements of the multi-element array can be combined together to form a single signal. They are typically not just added; each element is operated on by some magnitude and phase such that the combined signal will be "cleaner" (less noise and interference) than individual signals. Under a circumstance of jamming presence, with proper weight vector, jamming signals can be reduced or removed. One example of weight vector algorithm is minimal mean square error (MMSE). This method, in the ideal case, maximizes the signal to noise+interference (SINR) ratio of the signal after combining. The MMSE weight vector, denoted as w, (vector of magnitude and phase 'weights' to apply to each of the elements) can be calculated from the relative cross correlation vector and covariance matrix, $w=R_x^{-1}r_{xd}$, where $R_x^{-1}$ is the inverse of the covariance matrix. The MMSE weight vector can reduce interference from sources having angular separation from the desired source. This is valid for other network sources and jammers. If the array is calibrated, and the position of a jamming signal is known, then constrained beamforming can point to the desired source and place a null on the jammer, with only the relative cross correlation vector (no covariance needed).

Figure 3:
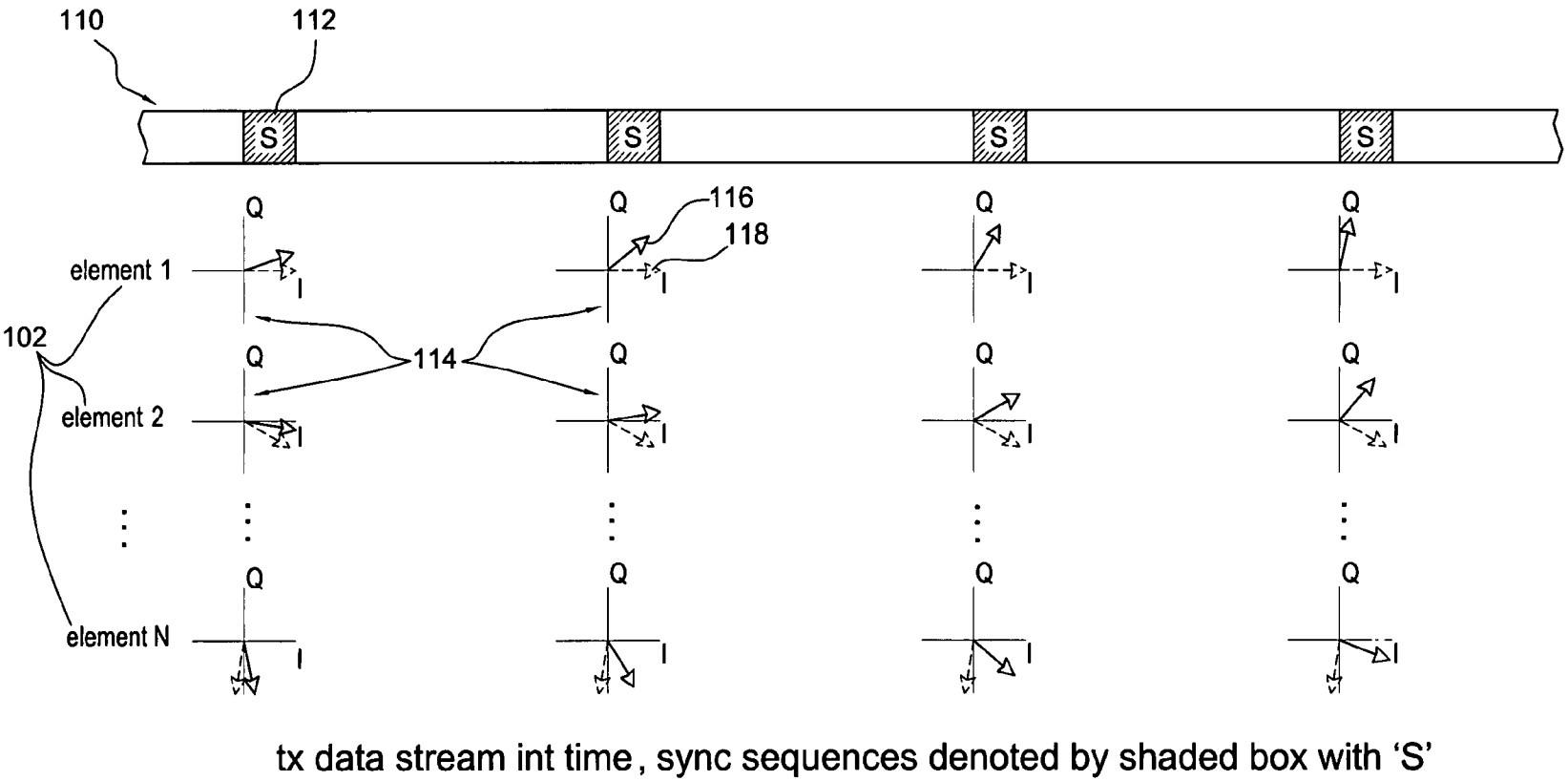
FIG. 3 illustrates cross correlation phases at synchronization sequences.

Referring now to FIG. 3, the RF signals 110 contain short repetitive synchronization sequence 112, shown in shaded box with 'S'. Below each synchronization sequence there is a column of phasor diagrams 114, one for each element in the multi-element antenna 102.

The solid arrow phasor 116 shows the phase of the synchronization sequence received at the respective antenna element.

The dashed arrow phasor 118 shows the correlation phase 'derotated' by the phase of the reference element. In this case, element 1 is the reference element, therefore, the dashed phasor for element 1 always has a phase of 0°. Notice that for every element, the dashed phasor has consistent phase, since it shows the phase difference with respect to the reference. In practice, each of the phasors will have noise due to a non-perfect correlation estimate; however, eliminating the absolute phase in favor of the relative allows the cross correlation results to be averaged, or filtered, in time.

Notice that, on any given element, phase increases with time, for example, due to local oscillator (LO) differences at the transmitter and receiver. Also notice that for any given synchronization the phase per element changes. This is due to the direction of arrival (DOA) of the signal. It is assumed that the DOA is stable over the four synchronization sequences shown.

The cross correlation results on temporally separate slices of receive data typically cannot be averaged or filtered due to the potential phase shift from one slice to the next. These phase shifts may be the result of LO differences between the transmitter and receiver, a Doppler shift due to movement, or a changing propagation channel. With additional effort, the frequency offset could be estimated and removed.

With frequency hopping, the phase at one frequency would not be the same as at another frequency, since the relative LO phase may change, and the propagation channel could not be relied on to have the expected result in the same phase at different frequencies.

Regardless, the relative phase of the elements of the cross correlation vector, not the absolute phase, is often of primary concern. Therefore, by referencing the cross correlation phase of all elements in the vector to a single element, the cross correlation vector contains relative phase. Given insignificant changes in antenna orientation from one cross correlation estimate to the next, the relative phase changes remain stable. This allows the 'relative' cross correlation vectors to be averaged or filtered, and provides an accurate cross correlation estimate that would not be possible using the standard cross correlation estimates.

Figure 4:
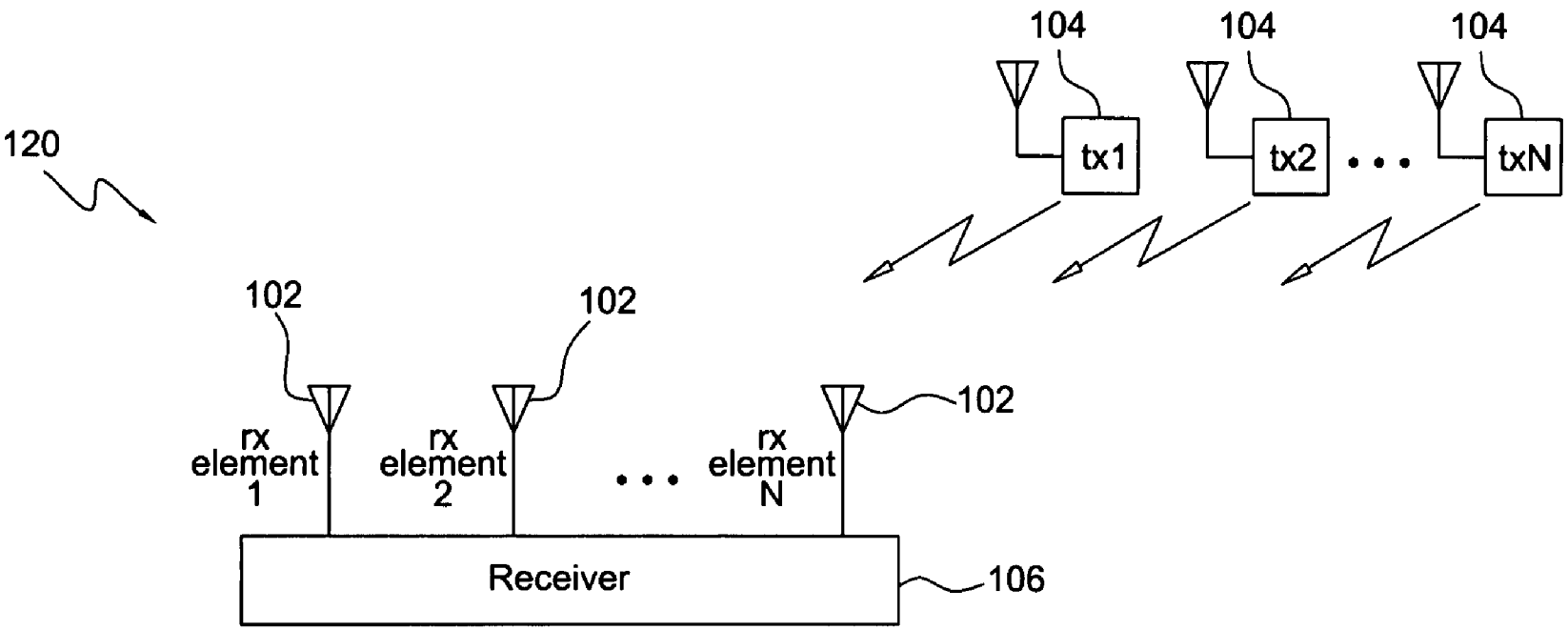
FIG. 4 illustrates an RF receiver system with a multi-element array antenna receiving RF signals from multiple RF transmitter sources.

Now referring to FIG. 4, an RF receiver system with a multi-element array antenna receiving RF signals from multiple RF transmitter sources that are transmitting on the same frequency at the same time is illustrated, generally designated as 120. The synchronization sequence for each source can be unique or the same. Furthermore, they may have different lengths. The content and/or length of the synchronization sequence can be used to indicate something about the data such as modulation, length of packet, etc., in which case, the synchronization sequence can change with source or even over time for a given source. The received signal from any one particular source will have interference from all the other sources. However, with an appropriate weight vector, the signals can be combined and a large portion of the interference can be removed from the source. Each source has its own weight vector, so that the same signals can be combined with different weights to resolve the data stream from the different sources.

Figure 5:
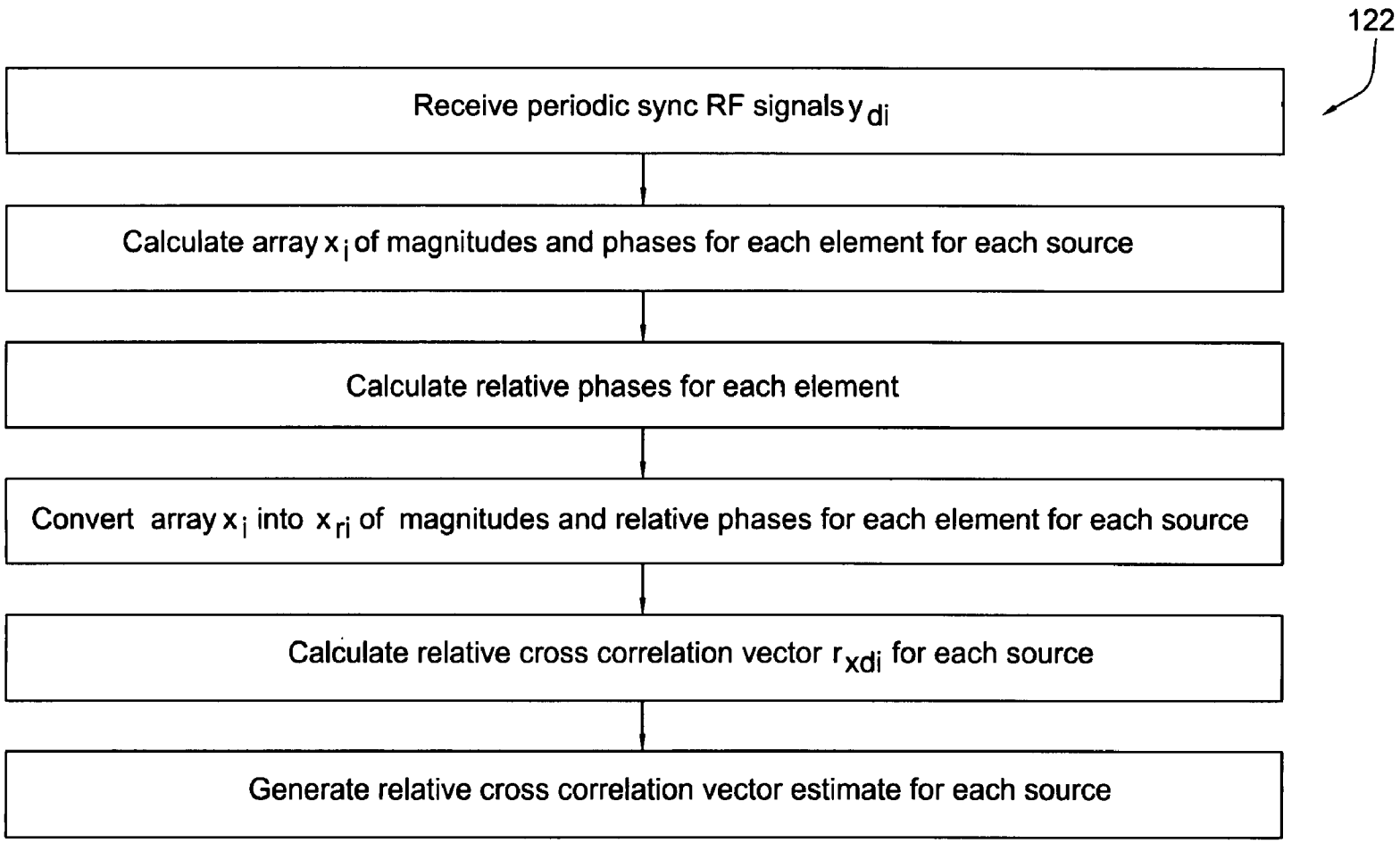
FIG. 5 is a block diagram of enabling DBF techniques for RF receiver systems having short repetitive synchronization sequences and receiving RF signals from multiple sources transmitting on the same frequency and at the same time.

Referring now to FIG. 5, a block diagram of a method of enabling DBF techniques for RF receiver systems with a multi-element array antenna having short repetitive synchronization sequences receiving RF signals from multiple sources transmitting on the same frequency at the same time in a noise environment is illustrated, generally designated at 122. The method can be summarized by the following steps:

a) receiving repetitive synchronization RF signals from multiple sources utilizing a multi-element array antenna, each of the repetitive synchronization RF signals including an ideal known synchronization sequence, the ideal known synchronization sequence being denoted as $y_{di}$ and a length of the ideal known synchronization sequence being denoted as $N_{di}$, where $i=0, 1, \ldots m-1$, and m is the total number of sources;

b) calculating a sequence of magnitudes and phases for each element of the multi-element array antenna corresponding to each of the ideal known synchronization sequences in the received synchronization RF signals, the sequence of the magnitudes and the phases comprising an array of N elements and being denoted as $x_i$, wherein the phases are also referred to as absolute phases;

c) calculating a relative phase for each element in the sequence of the magnitudes and the absolute phases by referencing the absolute phases of all elements in the array $x_i$ of N elements to a phase of a single element in the array $x_i$ of N elements;

d) converting the array $x_i$ of N elements with the magnitudes and the absolute phases into an array of N elements with the magnitudes and the relative phases by replacing each of the absolute phases in the array $x_i$ of N elements with the calculated relative phase for each element, the array of N elements with the magnitudes and the relative phases being denoted as $x_{ri}$;

e) calculating a relative cross correlation vector for each element of the multi-element array antenna utilizing $x_{ri}$ and $y_{di}$, the relative cross correlation vector being denoted as $r_{xdi}$, where $r_{xdi}=E\{x_{ri}y_{di}^*\}$ and * is a complex conjugate; and, f) generating a relative cross correlation vector estimate by filtering $r_{xdi}$, for use with DBF techniques.

Similar to the method of enabling DBF techniques for RF receiver systems with a multi-element array antenna having short repetitive synchronization sequences receiving RF signals in a noise environment, the relative cross correlation vector estimate may further be utilized for maximal ratio combining (MRC) and in a weight vector algorithm for each source to reduce jamming, and $x_{ri}$ may further be utilized for calculating covariance matrix $R_{xj}$, where $R_{xj}=E\{x_{ri}x_{rj}^H\}$ and H is Hermitian transpose.

The 'derotation' by a reference element's phase and averaging could also be used in a frequency hopped system. If the range of frequencies hopped over were large with respect to the antenna geometry, it may be necessary to normalize the phase in order to average.

Figure 6:
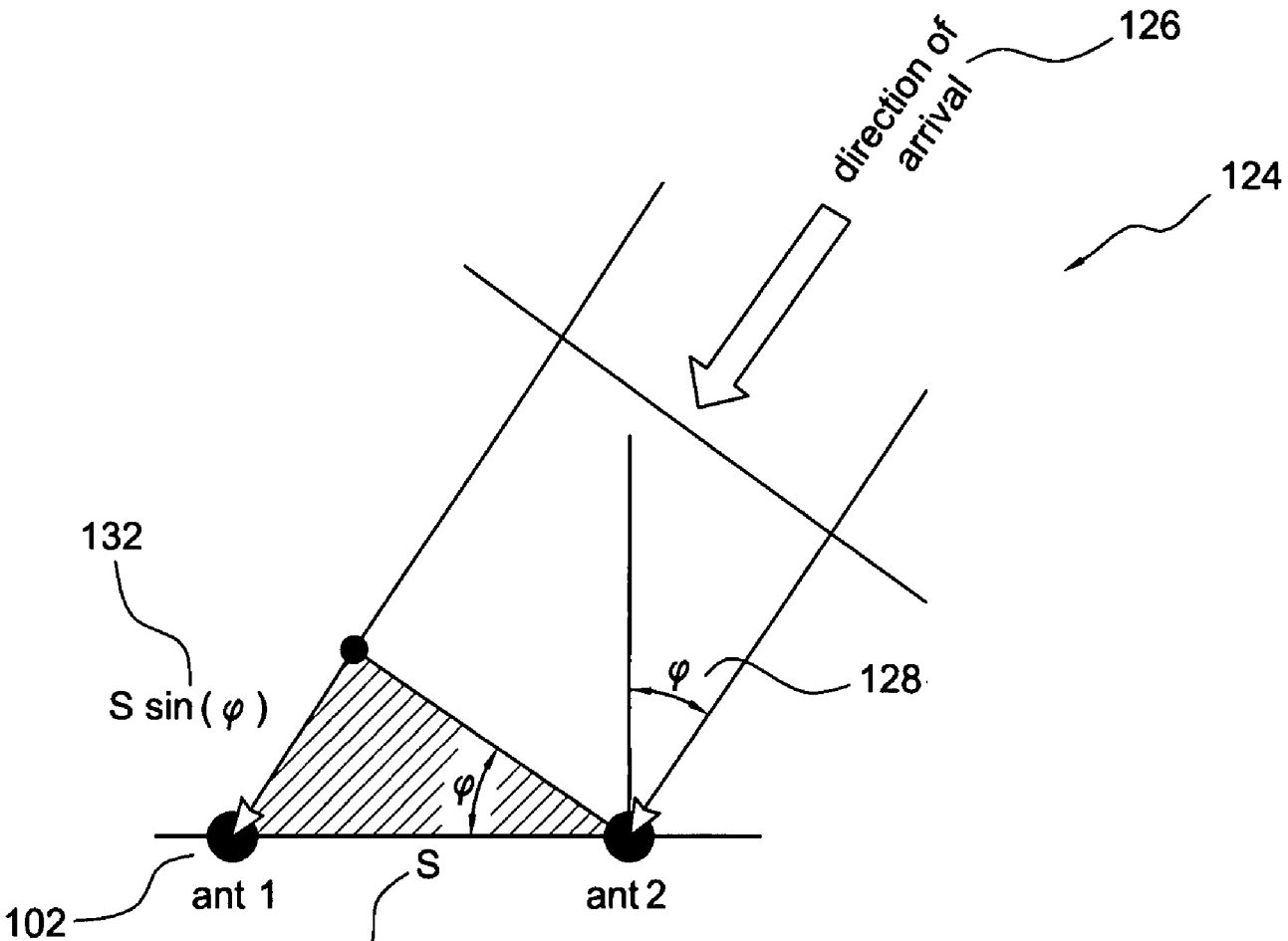
FIG. 6 illustrates a path difference between two elements of a multi-element array due to direction of arrival.

Now referring to FIG. 6, a path difference between two elements of a multi-element array due to direction of arrival is illustrated, generally designated as 124. A signal arrives from a given direction of arrival (DOA) 126 and an angle 128 of the DOA is denoted as $\phi$. A distance 130 between two elements 102 of the multi-element array is denoted as S. The phase difference 132 of the signal arriving at the elements is a result of the difference in propagation distance to the elements. With antenna separation of S, the path difference is $S\cdot\sin(\phi)$. The phase difference in degrees is the distance divided by the wavelength, $\lambda$, multiplied by 360, i.e. $360\cdot S\cdot\sin(\phi)/\lambda$. Given $F_1$ and $F_2=F_1/2$, $\lambda_1$ is half $\lambda_2$, where $F_1$ and $F_2$ are two hopped frequencies of the RF receiver system, the phase difference over this path is halved when using $F_2$ compared to $F_1$, $(360\cdot S\cdot\sin(\phi)/\lambda_2)/(360\cdot S\cdot\sin(\phi)/\lambda_1)=(\lambda_1/\lambda_2)=1/2$. With knowledge of the frequency and antenna spacing, the frequency hopped cross correlation results can be normalized, filtered, then converted to the receive frequency at which it is to be applied. To use this technique, the antenna spacing must be such that the phase can be determined without ambiguity for all frequencies. Therefore, the antenna spacing would have to be such that the path differences would provide unambiguous phase at the highest frequency (shortest wavelength).

Figure 7:
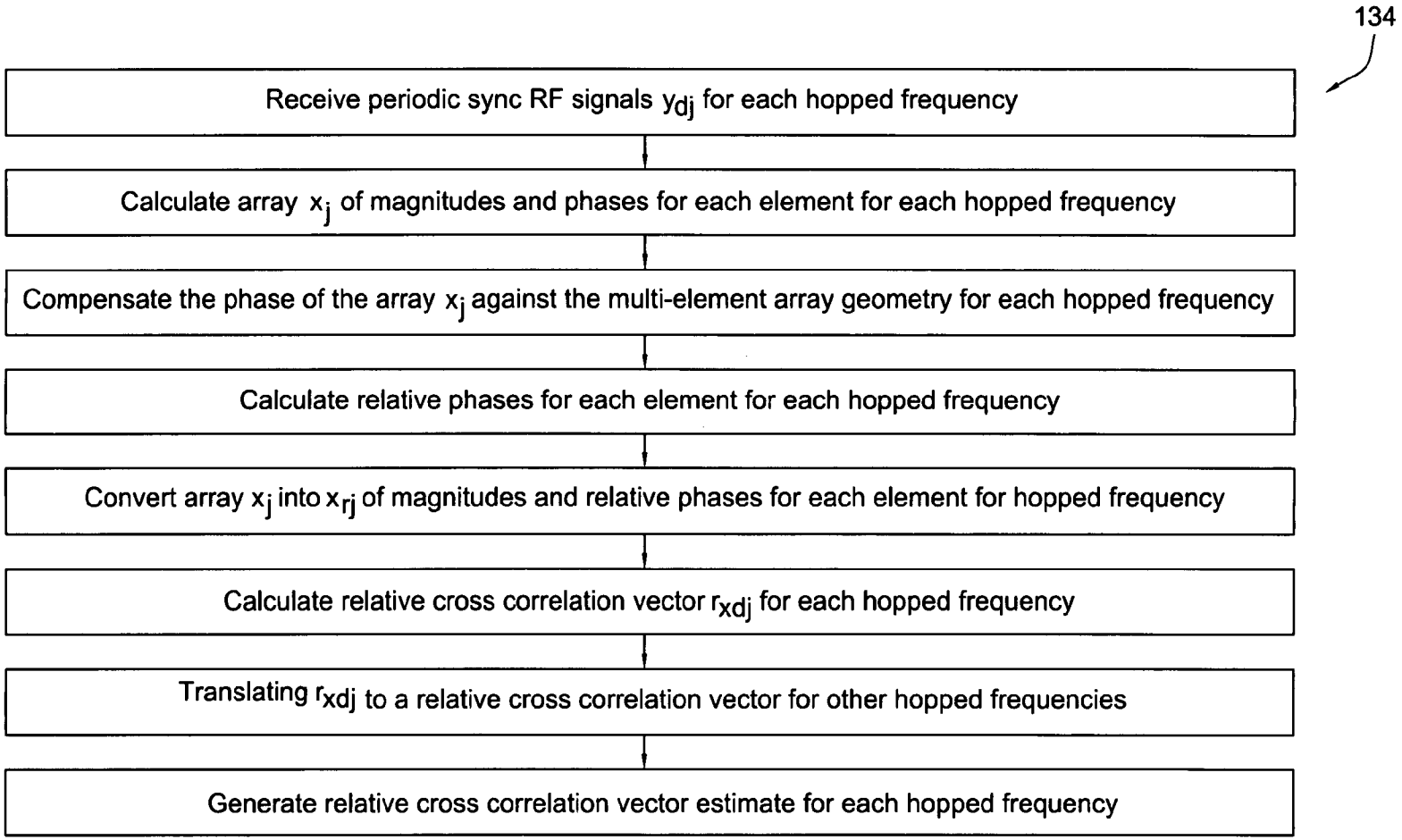
FIG. 7 is a block diagram of enabling DBF techniques for RF receiver systems having short repetitive synchronization sequences and frequency hopping.

Referring now to FIG. 7, a block diagram of a method of enabling DBF techniques for RF frequency hopped receiver systems with a multi-element array antenna having short repetitive synchronization sequences receiving RF signals in a noise environment is illustrated, generally designated at 134. The RF systems have a relatively large frequency hop range compared to a carrier frequency. The method can be summarized by the following steps:

a) receiving repetitive synchronization RF signals utilizing a multi-element array antenna, each of the repetitive synchronization RF signals comprising an ideal known synchronization sequence for each hopped frequency, the ideal known synchronization sequence for each of the hopped frequencies is denoted as $y_{dj}$ and a length of the ideal known synchronization sequence is denoted as $N_{dj}$, the hopped frequency is denoted as $f_j$, where j=0, 1, . . . k−1 and k is the total number of hopped frequencies;

b) calculating a sequence of magnitudes and phases for each element of the multi-element array antenna corresponding to each of the ideal known synchronization sequences for each of the hopped frequencies in the received synchronization RF signals, the sequence of the magnitudes and the phases comprises an array of N elements and is denoted as $x_j$, wherein the phases are also referred to as absolute phases;

c) compensating the phase of the array $x_j$ utilizing information regarding multi-element array geometry for each of the hopped frequencies;

d) calculating a relative phase for each element in the sequence of the magnitudes and the absolute phases by referencing the absolute phases of all elements in the array $x_j$ of N elements to a phase of a single element in the array $x_j$ of N elements;

e) converting the array $x_j$ of N elements with the magnitudes and the absolute phases into an array of N elements with the magnitudes and the relative phases by replacing each of the absolute phases in the array $x_j$ of N elements with the calculated relative phase for each element, the array of N elements with the magnitudes and the relative phases is denoted as $x_{rj}$;

f) calculating a relative cross correlation vector for each element of the multi-element array antenna utilizing $x_{rj}$ and $y_{dj}$, the relative cross correlation vector is denoted as $r_{xdj}$, where $r_{xdj}=E\{x_{rj}y_{dj}^*\}$ and * is a complex conjugate;

g) translating $r_{xdj}$ to a relative cross correlation vector corresponding to other hopped frequencies $f_i$ with the information regarding the multi-element array geometry, where i=0, 1, . . . k−1 and i≠j; and, h) generating a relative cross correlation vector estimate by filtering $r_{xdj}$, for use with DBF techniques.

Similar to the method of enabling DBF techniques for RF receiver systems with a multi-element array antenna having short repetitive synchronization sequences receiving RF signals in a noise environment, the relative cross correlation vector estimate may further be utilized for maximal ratio combining (MRC) and in a weight vector algorithm for reducing jamming, and $x_{ri}$ may further be utilized for calculating covariance matrix $R_{xj}$, where $R_{xj}=E\{x_{rj}x_{rj}^H\}$ and H is Hermitian transpose.

Under a circumstance of a wavelength of the lowest and highest hopped frequency changing by a relatively small amount, the element separation of the multi-element array, being expressed in wavelengths of the hopped frequency, is deemed static and compensation of the phase of the array $x_j$ against multi-element array geometry for each of the hopped frequencies can be skipped.

Other embodiments and configurations may be devised without departing from the spirit of the invention and the scope of the appended claims.

The invention claimed is:

1. A method for enabling digital beamforming (DBF) techniques within a system having a multi-element array antenna receiving RF signals in a noise environment, said RF signals having short repetitive synchronization sequences, said method of enabling DBF techniques, comprising the steps of:

a) receiving repetitive synchronization RF signals utilizing a multi-element array antenna, each of said repetitive synchronization RF signals comprising an ideal known synchronization sequence, said ideal known synchronization sequence being denoted as $y_d$ and a length of said ideal known synchronization sequence being denoted as $N_d$;

b) calculating a sequence of magnitudes and phases for each element of said multi-element array antenna corresponding to each of said ideal known synchronization sequences in said received synchronization RF signals, said sequence of said magnitudes and said phases comprising an array of N elements and being denoted as x, wherein said phases are also referred to as absolute phases;

c) calculating a relative phase for each element in said sequence of said magnitudes and said absolute phases by referencing said absolute phases of all elements in said array x of N elements to a phase of a single element in said array x of N elements;

d) converting said array x of N elements with said magnitudes and said absolute phases into an array of N elements with said magnitudes and said relative phases by replacing each of said absolute phases in said array x of N elements with said calculated relative phase for each element, said array of N elements with said magnitudes and said relative phases being denoted as $x_r$;

e) calculating a relative cross correlation vector for each element of said multi-element array antenna utilizing said $x_r$ and said $y_d$, said relative cross correlation vector being denoted as $r_{xd}$, where $r_{xd}=E\{x_r y_d^*\}$ and * is a complex conjugate; and, f) generating a relative cross correlation vector estimate by filtering said $r_{xd}$, for use with DBF techniques.

2. The method of claim 1, further comprising the step of utilizing said relative cross correlation vector estimate for maximal ratio combining.

3. The method of claim 1, further comprising the step of utilizing said $x_r$ to calculate a covariance matrix containing results of signals arriving on any element of said multi-element array antenna with signals arriving on all other elements of said multi-element array antenna, said covariance matrix being denoted as $R_x$, where $R_x=E\{x_r x_r^H\}$ and H is Hermitian transpose.

4. The method of claim 1, further comprising the step of utilizing said relative cross correlation vector estimate in a weight vector algorithm, said weight vector algorithm combining said magnitude and said phase for each element with certain weight to form a combined single signal such that said combined signal being less noise and interference.

5. The method of claim 1, wherein said step of calculating a relative phase for each element in said sequence of said magnitudes and said absolute phases, comprises the step of subtracting a phase of a single element in said array x of N elements from said absolute phases of all elements in said array x of N elements.

6. A method for enabling digital beamforming (DBF) techniques within a system having a multi-element array antenna receiving RF signals from a plurality of sources transmitting on the same frequency at the same time in a noise environment, said RF signals having short repetitive synchronization sequences, said method of enabling DBF techniques, comprising the steps of:

a) receiving repetitive synchronization RF signals from said plurality of sources utilizing a multi-element array antenna, each of said repetitive synchronization RF signals comprising an ideal known synchronization sequence, said ideal known synchronization sequence being denoted as $y_{di}$ and a length of said ideal known synchronization sequence being denoted as $N_{di}$, where i=0, 1, . . . m−1, and m is the total number of said plurality of sources;

b) calculating a sequence of magnitudes and phases for each element of said multi-element array antenna corresponding to each of said ideal known synchronization sequences in said received synchronization RF signals, said sequence of said magnitudes and said phases comprising an array of N elements and being denoted as $x_i$, wherein said phases are also referred to as absolute phases;

c) calculating a relative phase for each element in said sequence of said magnitudes and said absolute phases by referencing said absolute phases of all elements in said array $x_i$ of N elements to a phase of a single element in said array $x_i$ of N elements;

d) converting said array $x_i$ of N elements with said magnitudes and said absolute phases into an array of N elements with said magnitudes and said relative phases by replacing each of said absolute phases in said array $x_i$ of N elements with said calculated relative phase for each element, said array of N elements with said magnitudes and said relative phases being denoted as $x_{ri}$;

e) calculating a relative cross correlation vector for each element of said multi-element array antenna utilizing said $x_{ri}$ and said $y_{di}$, said relative cross correlation vector being denoted as $r_{xdi}$, where $r_{xdi}=E\{x_{ri} y_{di}^*\}$ and * is a complex conjugate; and, f) generating a relative cross correlation vector estimate by filtering said $r_{xdi}$, for use with DBF techniques.

7. The method of claim 6, further comprising the step of utilizing said relative cross correlation vector estimate for maximal ratio combining.

8. The method of claim 6, further comprising the step of utilizing said $x_{ri}$ to calculate a covariance matrix corresponding to each of said sources containing results of signals arriving on any element of said multi-element array antenna with signals arriving on all other elements of said multi-element array antenna, said covariance matrix being denoted as $R_{xi}$, where $R_{xi}=E\{x_{ri} x_{ri}^H\}$ and H is Hermitian transpose.

9. The method of claim 6, further comprising the step of utilizing said relative cross correlation vector estimate in a weight vector algorithm, said weight vector algorithm combining said magnitude and said phase for each element with certain weight to form a combined single signal such that said combined signal minimizes noise and interference.

10. The method of claim 6, wherein said step of calculating a relative phase for each element in said sequence of said magnitudes and said absolute phases, comprises the step of subtracting a phase of a single element in said array $x_i$ of N elements from said absolute phases of all elements in said array $x_i$ of N elements.

11. A method for enabling digital beamforming (DBF) techniques within a system having a multi-element array antenna receiving RF signals in a noise environment, said system being a frequency hopped system with a relatively large hop range compared to a carrier frequency, said RF signals having short repetitive synchronization sequences, said method of enabling DBF techniques, comprising the steps of:

a) receiving repetitive synchronization RF signals utilizing a multi-element array antenna, each of said repetitive synchronization RF signals comprising an ideal known synchronization sequence for each hopped frequency, said ideal known synchronization sequence for each of said hopped frequencies being denoted as $y_{dj}$ and a length of said ideal known synchronization sequence being denoted as $N_{dj}$, said hopped frequency being denoted as $f_j$, where j=0, 1, . . . k−1 and k is the total number of hopped frequencies;

b) calculating a sequence of magnitudes and phases for each element of said multi-element array antenna corresponding to each of said ideal known synchronization sequences for each of said hopped frequencies in said received synchronization RF signals, said sequence of said magnitudes and said phases comprising an array of N elements and being denoted as $x_j$, wherein said phases are also referred to as absolute phases;

c) compensating said phase of said array $x_j$ utilizing information regarding multi-element array geometry for each of said hopped frequencies;

d) calculating a relative phase for each element in said sequence of said magnitudes and said absolute phases by referencing said absolute phases of all elements in said array $x_j$ of N elements to a phase of a single element in said array $x_j$ of N elements;

e) converting said array $x_j$ of N elements with said magnitudes and said absolute phases into an array of N elements with said magnitudes and said relative phases by replacing each of said absolute phases in said array $x_j$ of N elements with said calculated relative phase for each element, said array of N elements with said magnitudes and said relative phases being denoted as $x_{rj}$;

f) calculating a relative cross correlation vector for each element of said multi-element array antenna utilizing said $x_{rj}$ and said $y_{dj}$, said relative cross correlation vector being denoted as $r_{xdj}$, where $r_{xdj}=E\{x_{rj}y_{dj}^*\}$ and * is a complex conjugate;

g) translating said $r_{xdj}$ to a relative cross correlation vector corresponding to other hopped frequencies $f_i$ with said information regarding said multi-element array geometry, where i=0, 1, . . . k−1 and i≠j; and, h) generating a relative cross correlation vector estimate by filtering said $r_{xdj}$, for use with DBF techniques.

12. The method of claim 11, further comprising the step of utilizing said relative cross correlation vector estimate for maximal ratio combining.

13. The method of claim 11, further comprising the step of utilizing said relative cross correlation vector estimate in a weight vector algorithm, said weight vector algorithm combining said magnitude and said phase for each element with certain weight to form a combined single signal such that said combined signal minimizes noise and interference.

14. The method of claim 11 further comprising the step of utilizing said $x_{rj}$ to calculate a covariance matrix corresponding to each of said hopped frequencies containing results of signals arriving on any element of said multi-element array antenna with signals arriving on all other elements of said multi-element array antenna, said covariance matrix being denoted as $R_{xj}$, where $R_{xj}=E\{x_{rj}x_{rj}^H\}$ and H is Hermitian transpose.

15. The method of claim 11, wherein said step of compensating said phase of said array $x_j$ utilizing said information regarding said multi-element array geometry for each of said hopped frequencies is omitted, under a circumstance of a wavelength of the lowest and highest hopped frequency changing by a relatively small amount, the element separation of said multi-element array, being expressed in wavelengths of said hopped frequency, being deemed static.

16. The method of claim 11, wherein said step of calculating a relative phase for each element in said sequence of said magnitudes and said absolute phases, comprises the step of subtracting a phase of a single element in said array $x_j$ of N elements from said absolute phases of all elements in said array $x_j$ of N elements.

17. An RF receiver for enabling digital beam forming (DBF) techniques receiving RF signals in a noise environment, said RF signals having short repetitive synchronization sequences, said RF receiver, comprising:

at least one digital signal processor (DSP) for performing the following:

a) calculating a sequence of magnitudes and phases for each element of said multi-element array antenna corresponding to each of said ideal known synchronization sequences in said received synchronization RF signals, said sequence of said magnitudes and said phases comprising an array of N elements and being denoted as x, wherein said phases are also referred to as absolute phases;

b) calculating a relative phase for each element in said sequence of said magnitudes and said absolute phases by referencing said absolute phases of all elements in said array x of N elements to a phase of a single element in said array x of N elements;

c) converting said array x of N elements with said magnitudes and said absolute phases into an array of N elements with said magnitudes and said relative phases by replacing each of said absolute phases in said array x of N elements with said calculated relative phase for each element, said array of N elements with said magnitudes and said relative phases being denoted as $x_r$;

d) calculating a relative cross correlation vector for each element of said multi-element array antenna utilizing said $x_r$ and said $y_d$, said cross correlation vector being denoted as $r_{xd}$, where $r_{xd}=E\{x_ry_d^*\}$ and * is a complex conjugate; and, e) generating a relative cross correlation vector estimate by filtering said $r_{xd}$, for use with DBF techniques.

18. An RF system for receiving RF signals in a noise environment, said RF signals having short repetitive synchronization sequences, said RF system, comprising:

a) a multi-element array antenna for receiving repetitive synchronization RF signals, each of said repetitive synchronization RF signals comprising an ideal known synchronization sequence, said ideal known synchronization sequence being denoted as $y_d$ and a length of said ideal known synchronization sequence being denoted as $N_d$; and, b) an RF receiver, comprising at least one DSP for performing the following:

i. calculating a sequence of magnitudes and phases for each element of said multi-element array antenna corresponding to each of said ideal known synchronization sequences in said received synchronization RF signals, said sequence of said magnitudes and said phases comprising an array of N elements and being denoted as x, wherein said phases are also referred to as absolute phases;

ii. calculating a relative phase for each element in said sequence of said magnitudes and said absolute phases by referencing said absolute phases of all elements in said array x of N elements to a phase of a single element in said array x of N elements;

iii. converting said array x of N elements with said magnitudes and said absolute phases into an array of N elements with said magnitudes and said relative phases by replacing each of said absolute phases in said array x of N elements with said calculated relative phase for each element, said array of N elements with said magnitudes and said relative phases being denoted as $x_r$;

iv. calculating a relative cross correlation vector for each element of said multi-element array antenna utilizing said $x_r$ and said $y_d$, said cross correlation vector being denoted as $r_{xd}$, where $r_{xd}=E\{x_ry_d^*\}$ and * is a complex conjugate; and, v. generating a relative cross correlation vector estimate by filtering said $r_{xd}$, for use with DBF techniques.

* * * * *